US006901664B2

(12) United States Patent
Melton et al.

(10) Patent No.: US 6,901,664 B2
(45) Date of Patent: Jun. 7, 2005

(54) HAIR CLIPPER AND SEAL

(75) Inventors: Scott Melton, Erie, IL (US); Michael Eddinger, Rock Falls, IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 10/197,756

(22) Filed: Jul. 18, 2002

(65) Prior Publication Data

US 2004/0010922 A1 Jan. 22, 2004

(51) Int. Cl.[7] ..... B26B 19/06
(52) U.S. Cl. ..... 30/210; 30/43.92
(58) Field of Search ..... 30/43.92, 45, 346.51, 30/210, 216, 228, 43.4, 43.6, 49

(56) References Cited

U.S. PATENT DOCUMENTS 3,266,143 A * 8/1966 Rangus ..... 30/224
4,991,295 A * 2/1991 Messinger ..... 30/43.92

* cited by examiner

*Primary Examiner*—Douglas D Watts
(74) *Attorney, Agent, or Firm*—Greer, Burns & Crain, Ltd.

(57) ABSTRACT

A seal for sealing a gap defined between a blade assembly and a housing of a clipper has a sealing portion and a base portion. The sealing portion has a blade engaging side and a housing engaging side. At least one projection extends upwards from the housing engaging side for engaging the housing. At least one attachment formation is provided for releasably attaching the seal to a boss interior to the housing.

22 Claims, 5 Drawing Sheets

HAIR CLIPPER AND SEAL

BACKGROUND OF THE INVENTION

The present invention relates to hand held clippers for trimming hair and the like. More particularly, the present invention is related to seals for sealing a gap in an electric hand held clipper housing, as well as to clippers having a seal for sealing a housing gap.

Hand held clippers for trimming and shearing hair are generally known in the art. Conventional clippers typically include a housing that contains a motor, with the motor drivingly attached to a blade assembly for trimming or cutting the hair. The blade assembly typically has a reciprocating blade that cooperates with a fixed blade to trim or clip hair. The housing may have a front opening for passing an operative portion of the fixed and moving blades. A gap generally exists between the blade assembly and the housing. This gap can have several disadvantages associated with it.

For example, the gap may be proximate the operating portion of the blades and therefore be regularly exposed to cut portions of hair. The hair cuttings can enter the clipper housing through the gap and can be harmful to operation of the clipper. Cuttings can become tangled between the moving and non-moving blade, increase friction between the two blades, and over time may even shorten the stroke of the moving blade. Hair cuttings can likewise interfere with operation of the motor and its linkage to the moving blade. Further, hair cuttings can trap dust, grease, and other debris. These and other problems with hair cuttings are particularly troublesome because hair cuttings are notoriously slow to decompose and difficult to disengage once entangled. These problems can result in the need for frequent disassembly and cleaning of clippers, and if not effectively addressed can lead to a substantially shortened clipper service life.

Some solutions to these problems have been proposed in the past. To date, however, the proposed solutions have been deficient. For example, a proposed solution has been to secure an insert in the gap using an adhesive. Often a foam insert has been used. While such foam inserts may limit entry of hair into the clipper housing for a period of time, experience has suggested them to be limited in effectiveness and service life. For example, some foam inserts tend to disintegrate after a period of use and to thereby re-open the gap for entry of hair cuttings. Also, disintegration may cause small portions of the foam to come loose, with these small portions potentially interfering with clipper operation in the same way that the hair cuttings do. Other types of foam inserts have been known to collect hair in the foam itself to the extent that clipper operation may be impaired.

Further, the adhesive used to secure an insert of the prior art can have a tacky surface that may disadvantageously attract and retain hair cuttings. This can be particularly troublesome when the adhesive surface gradually becomes exposed over time as the foam disintegrates. Also, the adhesives holding some inserts in place tend to weaken with age and use, with the result that the insert may come loose.

In addition to these problems, foam inserts have proven to be difficult to replace. Because the service life of the foam insert is often considerably shorter than that of the clipper, consumers must be relied upon to replace the inserts. This is disadvantageous because many users either do not have the expertise to replace the inserts or are not willing to go to the effort of replacing the inserts. As a result, clippers with foam inserts may have less than satisfactory operation and may suffer a shortened service life.

Finally, some clippers are intended to be used with different blade sizes and geometries. For example, a particular clipper may be designed to fit any of a plurality of interchangeable blade assemblies of different sizes. Each of these blades may have different geometries that result in the gap between them and the housing to be different. Known inserts are generally not able to effectively accommodate these different gap sizes.

Unresolved problems in the art therefore remain.

SUMMARY OF THE INVENTION

One embodiment of the present invention is directed to a seal for a hand held hair clipper. In particular, an invention embodiment is a seal for use with a hand held clipper of the type that has a blade assembly and a housing, with a gap defined between the blade assembly and the housing. The seal includes a sealing portion that has a housing engaging side for engaging an interior surface of the clipper housing and an opposite blade engaging side for engaging at least a portion of the clipper blade assembly. A base portion is provided for attaching the seal to the housing.

An additional embodiment of the invention is directed to an electric hair clipper having a housing that contains an electric motor with a blade assembly operatively linked to the motor. The housing has an opening for passing a portion of the blade assembly. A gap is defined in the opening between the blade assembly and the housing. The housing has an interior surface and at least one interior boss. A molded thermoplastic seal is provided for sealing the gap, with the seal having at least one attachment tab for mating with the at least one boss.

Embodiments of the present invention thereby offer a solution to many of the otherwise unresolved problems of the prior art. For example, a molded thermoplastic seal offers advantages of resiliency and a longer service life than foam seals of the prior art. Additionally, attaching a seal of the invention to the clipper housing with an attachment tab solves many problems associated with the use of adhesives with prior art seals. Those skilled in the art will appreciate that embodiments of the present invention offer many other advantages and resolve other problems of the prior art, as will be better detailed below.

DETAILED DESCRIPTION

Figure 1:
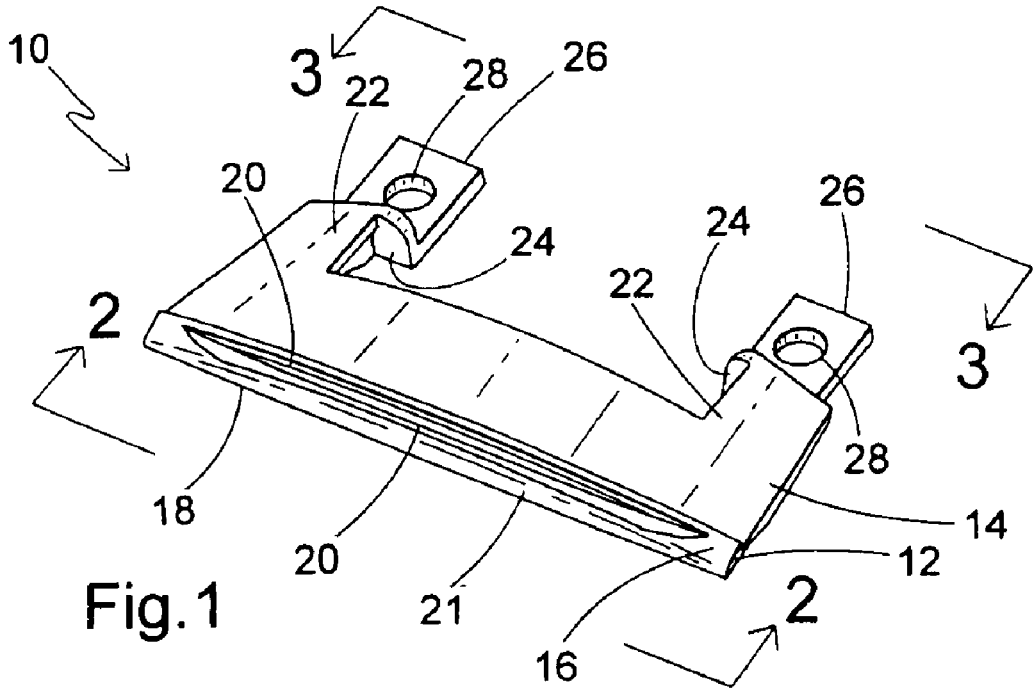
FIG. 1 is a perspective view of a preferred embodiment of a seal of the invention.

Turning now to FIGS. 1–6, a preferred seal shown generally at 10 has a sealing portion 12 integral with a base portion 14. The seal 10 is preferably made of a molded plastic, and most preferably a flexible, rubber-like elastomer such as neoprene. The sealing portion 12 has a housing engaging side 16 for engaging a clipper housing and an opposing blade engaging side 18 for engaging a clipper blade assembly. When the sealing portion 12 is so engaged in a clipper, the gap between a blade assembly and housing is sealed and thereby blocked from entry of hair cuttings.

Two elongate projections 20 extend upwards from the housing engaging side 16 to define a channel therebetween. In the preferred embodiment, two projections 20 are located adjacent an edge 21 of the housing engaging side 16. However, it is contemplated that the location, number, and precise configuration of the projections 20 may vary to suit a particular application. For example, only one projection is contemplated. The preferred projections 20 are relatively thin and pliable, and thereby readily adapt to the particular size of a gap between a blade assembly and housing. For example, the projections 20 may be substantially compressed against a housing interior surface when a relatively large blade assembly is installed, and may be relatively un-compressed when a smaller blade assembly is present. Providing at least two projections 20 minimizes the chances of an ineffective seal.

Two arms 22 extend in a generally rearward direction from the base portion 14 opposite the edge 21 and each has a generally vertical wall 24 descending therefrom. An attachment formation, preferably having the shape of an attachment tab 26, is connected to the base of at least one and preferably both of the walls 24. The attachment formation or tab 26 is for releasably attaching the seal 10 to a housing interior surface. The tab 26 may be releasably engaged to hold the seal 10 in place when it is "pinched" between cooperating housing structures upon assembly of the housing. Additionally, a throughbore 28 extends through each of the attachment tabs 26 for engaging a housing boss.

Many alternative configurations to the tabs 26 and throughbores 28 will be obvious to those knowledgeable in the art. By way of example and not limitation, attachment means for releasably attaching the seal to the housing such as an open, U-shaped throughbore, clips, lugs, mating hooks and loops, and the like could readily be practiced with other embodiments of the invention. Also, it will be appreciated that the arms 22 are preferred only, and that other invention embodiments may have attachment means that are not connected to the seal via the arms 22.

Figure 2:
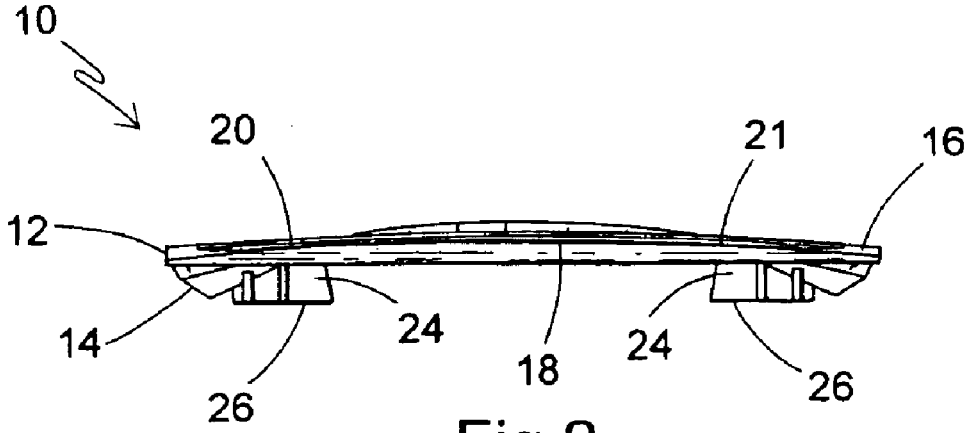
FIG. 2 is a front view of the seal of FIG. 1 taken along the line 2—2 of FIG. 1 and in the direction generally indicated.
Figure 3:
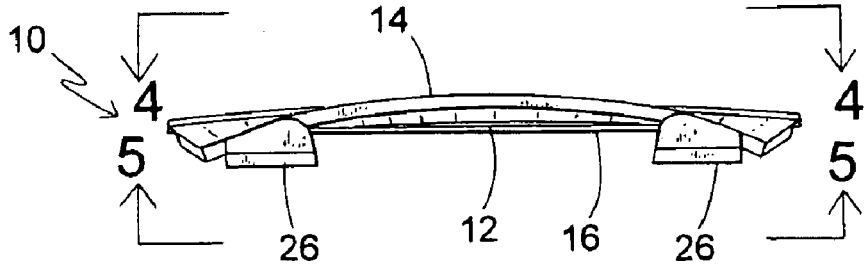
FIG. 3 is a rear view of the seal of FIG. 1 taken along the line 3—3 of FIG. 1 and in the direction generally indicated.
Figure 4:
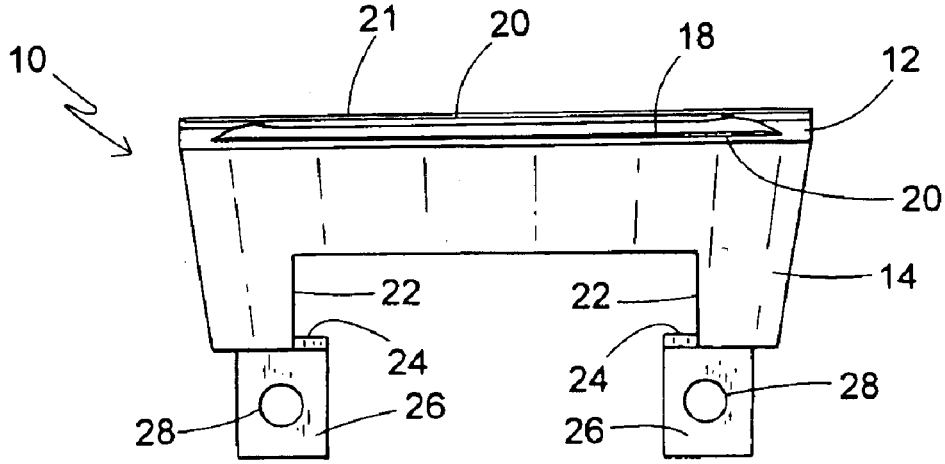
FIG. 4 is a top view of the seal of FIG. 1 taken along the line 4—4 of FIG. 3 and in the direction generally indicated.
Figure 5:
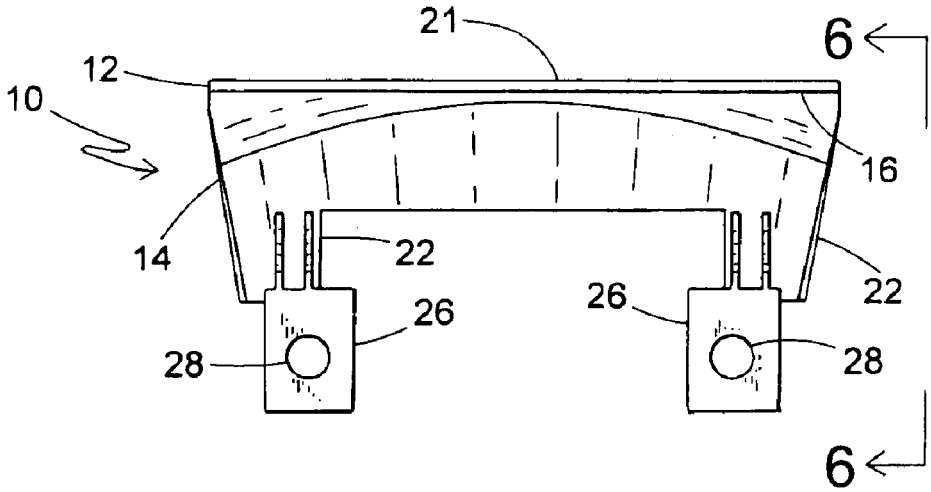
FIG. 5 is a bottom view of the seal of FIG. 1 taken along the line 5—5 of FIG. 3 and in the direction generally indicated.
Figure 6:
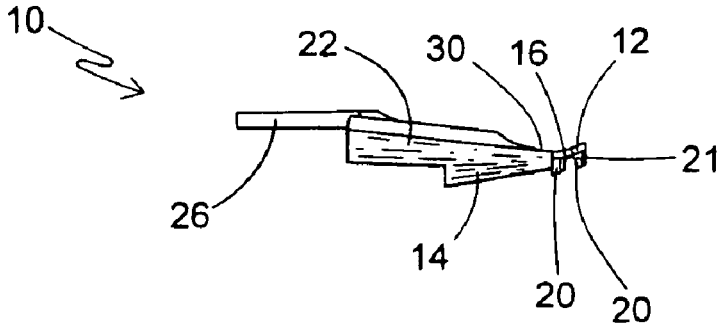
FIG. 6 is a side view of the seal of FIG. 1 taken along the line 6—6 of FIG. 5 and in the direction generally indicated.

The base portion 14 preferably has a generally arcuate shape in a cross direction, as best illustrated by FIGS. 2–3. As used herein, the cross direction will refer to the direction generally parallel to the axis of the extensions 20, while the longitudinal direction will refer to the direction generally parallel to the direction in which the arms 22 extend outward from the base portion 14. This arcuate shape is provided to generally match the contour of the upper housing 52 so as to provide an effective seal. It has also been discovered that the arcuate shape of the base portion 14 benefits the sealing function of the seal 10 in that it contributes a degree of stiffness to the generally flexible seal 10, and may also provide a pre-load or spring force. The stiffness and spring force are useful in urging the seal portion 12 into engagement with the blade assembly and housing.

Also, the sealing portion 12 is preferably thinner than the base portion 14. A thicker base portion 14 provides for strength and some degree of rigidity useful for urging the sealing portion 12 into place. A thinner sealing portion 12 is preferable for providing greater flexibility and pliability so that different blade sizes and geometries can be effectively engaged. At least a portion 30 (best seen in FIG. 6) of the blade engaging side 16 has a generally concave shape when viewed from the side for engaging a portion of a clipper blade assembly. Engagement with a portion of the clipper blade assembly will advantageously urge the seal 10 upwards into engagement with the clipper housing.

Referring now to FIGS. 7–10, the various elements of the seal 10 and their functions can be better illustrated through discussion of a preferred clipper generally designated 50 that uses a seal generally consistent with the seal 10. The clipper 50 has a housing that has upper and lower portions 52 and 54, respectively. The housing portions 52 and 54 are preferably made of a molded plastic selected for durability, cost, and the like as is known in the art. The housing contains an electric motor 56 (FIG. 9), which is connected to an AC power supply (not shown) by the cord 58. Those knowledgeable in the art will appreciate that a DC power supply, such as a battery, could alternatively be provided. The housing upper portion 52 has an interior surface 60 (FIGS. 7 and 8) having a pair of generally cylindrical depending bosses 62 and support walls 63. The particular shape, number, and location of the bosses 62 and walls 63 may vary to suit a particular application. The bosses 62 may be provided for the purpose of anchoring the seal 110. It is also contemplated, however, that the bosses 62 may be used for receiving a fastener such as a stud, screw, or the like that may be provided to attach the lower housing portion 54 to the upper housing portion 52. Those knowledgeable in the art will understand that housing portions 52 and 54 may include other structures and features, such as additional bosses, studs, support walls, and the like. Because these other structures and features are generally known, they will not be discussed herein for sake of brevity.

Figure 9:
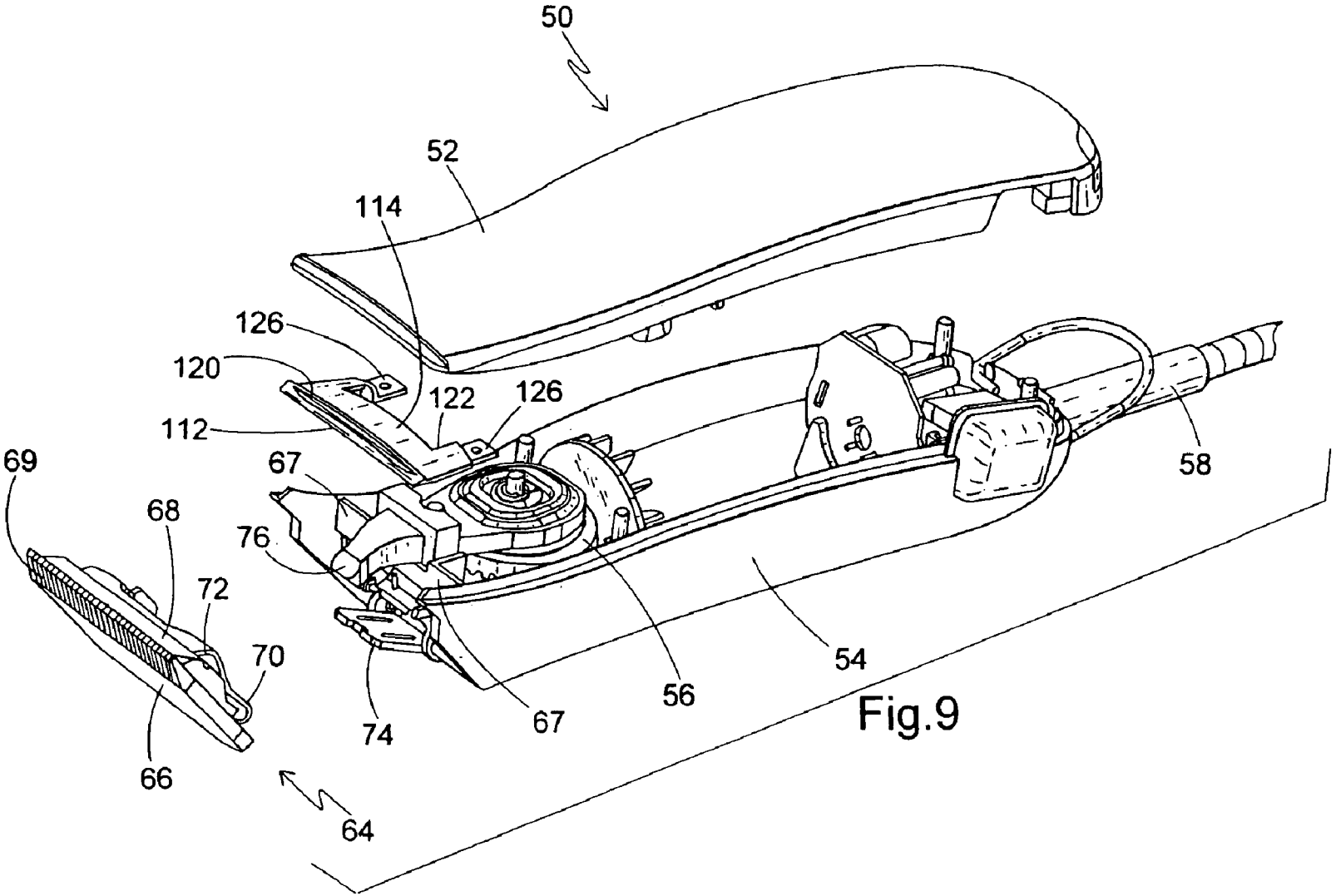
FIG. 9 is an exploded perspective view of the present clipper.
Figure 10:
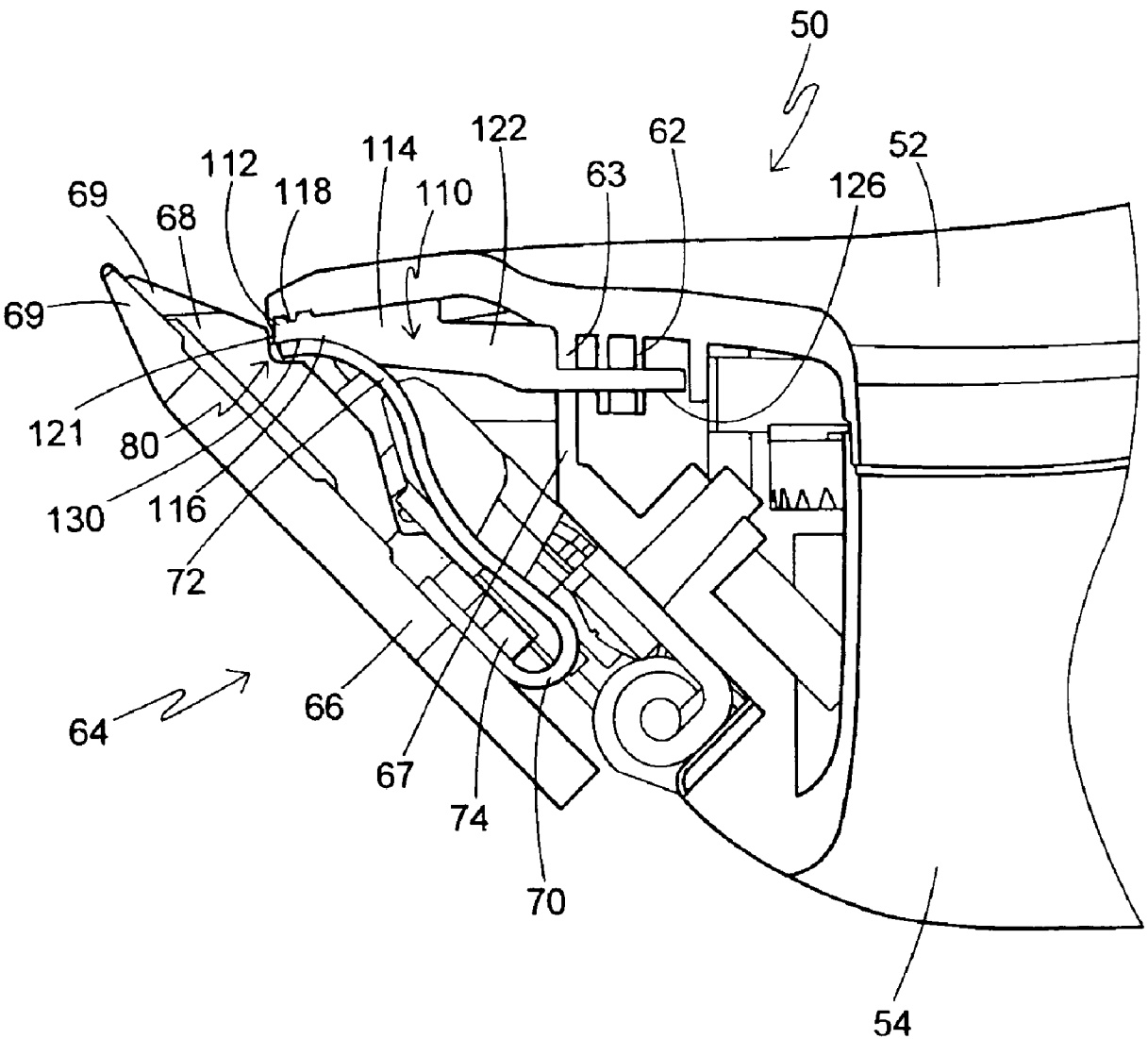
FIG. 10 is a fragmented vertical cross-section of the present clipper.

Referring now to FIGS. 9 and 10, the motor 56 is connected to a blade assembly shown generally at 64, which includes a fixed blade 66, a moving blade 68, and a tensioning spring 70 that urges the moving blade 68 into operative engagement with the fixed blade 66. Preferably, the clipper 50 may be used with any of a plurality of interchangeable blade assemblies 64, which may each be of different sizes or tooth configurations. As is typical in the art, the motor 56 is linked to the blade assembly 64 to cause the moving blade 68 to reciprocate in the cross direction. Hair may thereby be cut through a scissor-like action between cooperating teeth 69 at a cutting end 78 of the two blades 66 and 68. The tensioning spring 70 has at least a portion 72 that is generally arcuately shaped for providing spring force to urge the moving blade 68 into engagement with the fixed blade 66. The arcuately shaped portion 72 of the tensioning spring 70 is preferably movably received by the moving blade 68 so that the spring remains generally stationary while the blade 68 reciprocates.

As best illustrated by FIG. 9, the blade assembly 64 is installed in the assembled housing portions 52 and 54 by attaching the fixed blade 66 to a stud 74 and positioning the blade assembly 64 so that a cam drive 76 driven by the motor 56 is coupled to the moving blade 68. As best illustrated by FIG. 10, after installation the cooperating cutting teeth 69 of the blades 66 and 68 extend out of an opening 80 that is defined by the housing portions 52 and 54.

The seal shown generally at 110 effectively seals a gap defined between the blade assembly 64 and a perimeter edge of the housing opening 80. The seal 110 is generally consistent with the seal 10 illustrated in FIGS. 1–5. For convenience, element numbers consistent with those used for the seal 10 have been used in the 100 series for the seal 110. As best shown by the cross section of FIG. 10, a sealing portion 112 has a blade engaging side 116 that engages the blade assembly 64, and a housing engaging side 118 that engages a portion of the interior surface 60 of the housing portion 52. At least a portion 130 of the blade engaging side 116 has a generally concave shape in the longitudinal direction adapted to receive the arcuate portion 72 of the tensioning spring 70.

When the spring 70 engages the blade engaging side 116 of the flexible seal 110, it urges the spring upwards into engagement with the housing interior surface 60. The base portion 114 is preferably thicker than the sealing portion 112. In combination with its cross direction arcuate shape, this advantageously provides the base portion 114 with a degree of stiffness useful to urge the more flexible sealing portion 112 into effective sealing position between the blade assembly 64 and the housing interior surface 60. A thinner sealing portion 112 is advantageous so that the sealing portion is relatively flexible to accommodate use of different interchangeable blade assemblies 64, as well as tolerances in blade assemblies 64 and housings. Preferably, the thickness of the seal 110 is generally tapered from a front side 121 of the thinner sealing portion 112 moving rearwards to a back edge of the thicker base portion 114.

As best shown by FIG. 10, when the seal 110 is in place, contact with the tensioning spring 72 urges the housing engaging side 118 and its two pliable, elongate projections 120 into contact with the housing interior surface 60. The projections 120 on the engaging side 118 may thereby be compressed and flattened to insure effective sealing. The degree to which they are compressed will depend on the size of the blade assembly 64. The ability of these flexible projections 120 to compress by differing amounts further enhances the seal's 110 ability to accommodate different interchangeable blade assemblies 64. For example, one blade assembly 64 may require little or no compression of the projections 120, while a second larger blade assembly 64 may require the projections 120 to be more substantially compressed.

Figure 7:
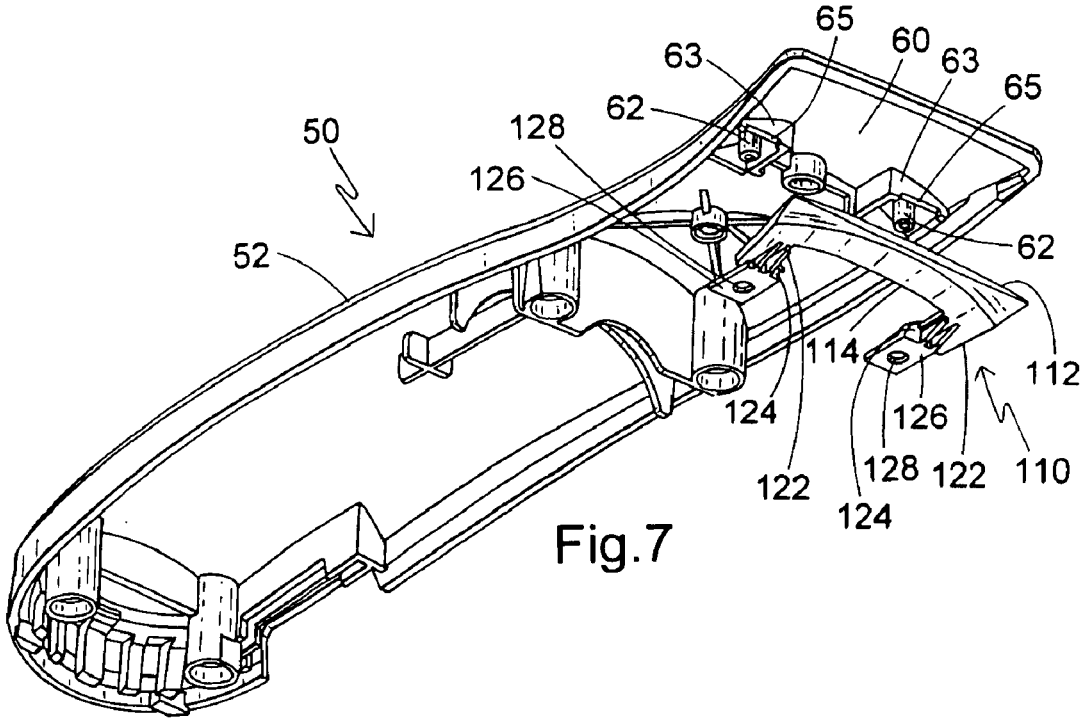
FIG. 7 is an exploded perspective view of a portion of a clipper of the invention.
Figure 8:
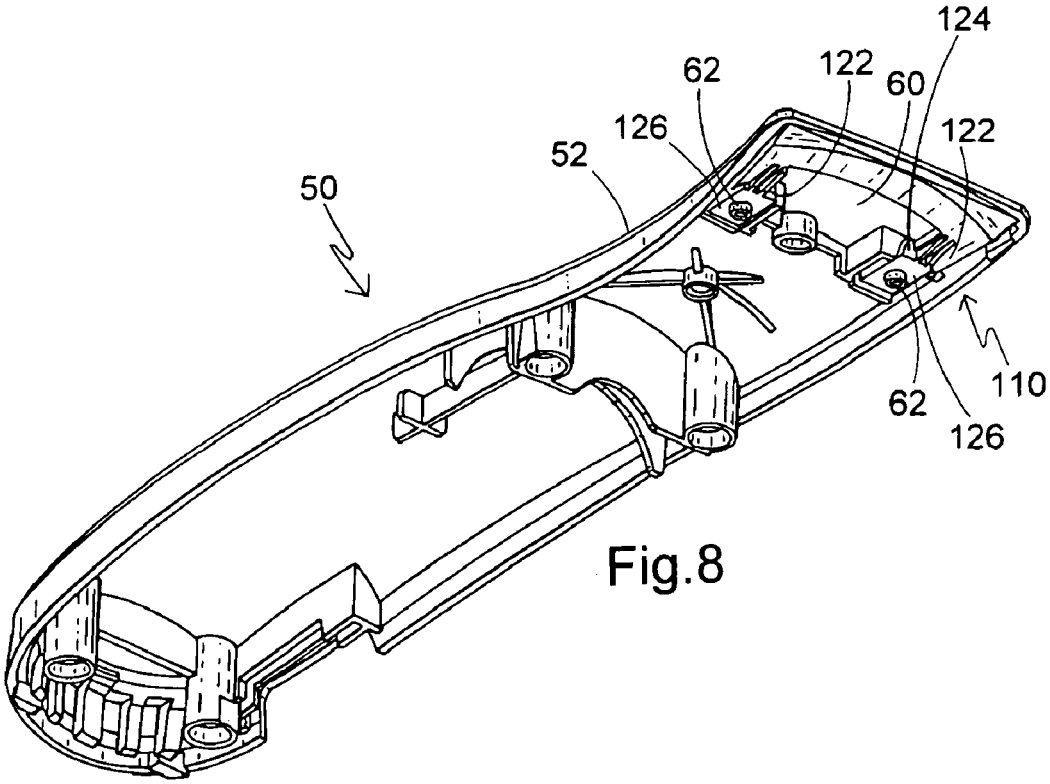
FIG. 8 is a bottom perspective view of an upper housing portion with the present seal installed.

Two arms 122 extend in a rearward direction from the base 114, with a generally vertical step or wall 124 at an end of the arms 122. An attachment formation or tab 126 is connected to the arms 122 and the wall 124 and is used to attach the seal 110 to the housing portion 52. Each of the attachment tabs 126 has a throughbore 128 for mating with one of the bosses 62, as best illustrated by FIG. 7 that shows the seal 110 being installed on the upper housing portion 52, and by FIG. 8 that shows the seal 110 installed. The boss 62 is received in the throughbore 128. This generally prevents movement of the seal 110 in a forward and reverse direction in relation to the clipper 50. To further lock the seal 110 in place, the clipper upper housing portion 52 is provided with a pair of support walls 63 that each has a slot 65 for receiving one of the attachment tabs 126. A pair of locking walls 67 are provided on the lower clipper housing portion 54 for cooperating with the support walls 63. When the two housing portions 52 and 54 are assembled, the locking wall 67 holds the attachment tab 126 in place in the slot 65 in a "pinching" manner as is illustrated by FIG. 10. It is also contemplated that the slot 65 could be formed in the locking wall 67, or that the walls 63 and 67 are configured to engage the tab 22 without provision of the slot 65.

This attachment configuration has been discovered to offer several advantages over the prior art. For example, the present attachment configuration renders the seal 110 securely "trapped" in place once the housing is assembled. The chance of the seal 110 coming unattached is minimal. No tools, adhesives, screws or other fasteners are required for attachment. Replacement of the seal 110 is therefore a straightforward task.

Those skilled in the art will appreciate that the preferred seal and clipper embodiments described herein have been discussed for illustration purposes only. Other embodiments are of course possible within the scope of the invention. Indeed, those knowledgeable in the art will recognize equivalents to elements of the described preferred embodiment that are within the scope of the claimed invention.

Various features are set forth in the appended claims.

What is claimed is:

1. A seal for use with a hand held clipper of the type that has a blade assembly including a moving blade and a fixed blade, a housing and a gap defined between the blade assembly and the housing, said seal comprising:

a sealing portion having a housing engaging side for engaging an interior surface of the clipper housing and a blade engaging side for engaging at least a portion of the clipper blade assembly, said blade engaging side opposite said housing engaging side; and, a base portion connected to said sealing portion, said base portion being configured for releasable attachment to the housing;

the housing has at least one internal boss, and further including at least one attachment tab on said seal for mating with the at least one internal boss;

said seal configured of a non-foam material so that upon attachment to the housing by said at least one attachment tab, said blade engagement side is configured for accommodating movement of the moving blade while preventing the entry of hair clippings into the gap.

2. A seal for use with a hand held clipper as defined by claim 1, wherein said housing engaging side further comprises at least one upwardly extending projection for engaging the interior surface of the clipper.

3. A seal for use with a hand held clipper as defined by claim 2, wherein said at least one projection comprises at least two elongate projections extending along a cross direction and being substantially parallel to one another to define a channel therebetween.

4. A seal for use with a hand held clipper as defined by claim 2 wherein said sealing portion is flexible, and wherein engagement between said blade engaging side and the blade assembly urges said at least one upwardly extending projection into engagement with the housing interior surface, thereby at least partially compressing said at least one upwardly extending projection.

5. A seal for use with a hand held clipper as defined by claim 1 wherein the clipper blade assembly comprises the fixed blade, the moving blade, and a blade tensioning spring for urging the moving blade into operational engagement with the fixed blade, and wherein at least a portion of said blade engaging side is adapted to engage the blade tensioning spring.

6. A seal for use with a hand held clipper as defined by claim 5 wherein at least a portion of the blade tensioning spring has an arcuate shape, and wherein at least a portion of said blade engaging side has a generally concave-shaped surface adapted to engage the arcuately-shaped at least a portion of the blade tensioning spring.

7. A seal for use with a hand held clipper as defined by claim 1 wherein the at least one boss comprises two bosses, wherein said at least one attachment tab comprises two attachment tabs, and wherein each of said two attachment tabs has a throughbore for receiving one of the two bosses.

8. A seal for use with a hand held clipper as defined by claim 1 wherein said base portion has at least one arm extending therefrom, a generally vertical wall descending from said at least one arm, said at least one tab connected to said generally vertical wall.

9. A seal for use with a hand held clipper as defined by claim 1 wherein the housing has a at least one support wall and at least one cooperating locking wall, and further including at least one attachment formation on said seal for being engaged between said support wall and said cooperating locking wall.

10. A seal for use with a hand held clipper as defined by claim 9 wherein a slot is provided in one of said support wall or said cooperating locking wall, said slot for receiving at least a portion of said attachment formation.

11. A seal for use with a hand held clipper as defined by claim 1 wherein said sealing portion is longitudinally forward of said base portion, and wherein the seal has a generally tapered thickness with said base portion being thicker than said sealing portion.

12. A seal for use with a hand held clipper as defined by claim 1 wherein said base portion has a generally arcuate shape in a cross direction.

13. A seal for use with a hand held clipper as defined by claim 1 wherein said sealing portion and said base portion are integral with each other and are formed of a molded elastomer.

14. An electric hair clipper comprising:

a housing, an electric motor contained in said housing, a blade assembly operatively linked to said motor, said housing having an opening for passing a portion of said blade assembly, a gap defined in said opening between said blade assembly and said housing, said housing having an interior surface and at least one boss;

a seal for sealing said gap, said seal having at least one attachment formation for engaging said at least one boss, said seal made of a molded thermoplastic; and said housing further includes at least one support wall and at least one cooperating locking wall for engaging said at least one attachment formation therebetween.

15. An electric hair clipper as defined by claim 14 wherein said at least one boss comprises a plurality of bosses, and wherein said at least one attachment formation comprises a plurality of attachment formations, each of said plurality of attachment formations having a throughbore adapted to mate with one of said plurality of bosses.

16. An electric hair clipper as defined by claim 14 wherein said at least one attachment formation comprises a pair of attachment tabs, wherein said seal comprises a sealing portion and an integral base portion, said base portion having two arms, one of said at least one attachment tabs connected to each of said arms.

17. An electric hair clipper as defined by claim 14 wherein said seal has a sealing portion and an integral base portion, at least a part of said base portion being arcuately shaped in the cross direction, and wherein said sealing portion has a blade engaging side for engaging said blade assembly and a housing engaging side with at least one upwardly extending projection for engaging said housing interior surface.

18. An electric hair clipper as defined by claim 17 wherein said blade assembly comprises a fixed blade, a moving blade, and a tensioning spring for urging said moving blade into operative engagement with said fixed blade, at least a portion of said tensioning spring having an arcuate shape, and wherein at least a portion of said blade engaging side has a concave shape adapted to receive said arcuately shaped tensioning spring portion.

19. An electric hair clipper as defined by claim 17 wherein said at least one upwardly extending projection comprises a pair of elongate projections, a channel defined between said projections, said pair of elongate projections at least partially compressed when said housing engaging side engages said housing interior surface.

20. An electric hair clipper as defined by claim 14 wherein said blade assembly comprises a first blade assembly, and wherein the electric hair clipper further comprises a second blade assembly interchangeable with said first blade assembly, said first and second blade assemblies having different sizes, and wherein said seal has at least one compressible projection, said at least one compressible projection compressed against said housing interior surface by a first amount when said first blade assembly is installed and compressed against said housing interior surface by a different amount when said second blade assembly is installed.

21. An electric hair clipper as defined by claim 14 wherein said at least one attachment formation comprises a plurality of attachment tabs, wherein said at least one support wall comprises a plurality of support walls, wherein said at least one cooperating locking wall comprises a plurality of cooperating locking walls, and wherein each of either said plurality of support walls or said plurality of cooperating locking walls is provided with a slot for receiving one each of said plurality of attachment tabs.

22. A seal for use with a hand held clipper of the type that has a blade assembly and a housing, comprising:

a sealing portion having a housing engaging side for engaging an interior surface of the clipper housing and a blade engaging side for engaging at least a portion of the clipper blade assembly, said blade engaging side opposite said housing engaging side;

a base portion connected to said sealing portion, said base portion being configured for releasable attachment to the housing; and said sealing portion is longitudinally forward of said base portion, and wherein the seal has a generally tapered thickness with said base portion being thicker than said sealing portion.

* * * * *